US011866075B2

(12) United States Patent
Hammerl et al.

(10) Patent No.: US 11,866,075 B2
(45) Date of Patent: Jan. 9, 2024

(54) METHOD FOR MONITORING THE POSITION OF A PARKED RAIL VEHICLE, AND COMPUTER PROGRAM, IN PARTICULAR FOR A TRAIN SAFETY SYSTEM

(71) Applicant: Siemens Mobility GmbH, Munich (DE)

(72) Inventors: Malte Hammerl, Braunschweig (DE); Jacob Johannes Kohlruss, Braunschweig (DE)

(73) Assignee: Siemens Mobility GmbH, Munich (DE)

( * ) Notice: Subject to any disclaimer, the term of this patent is extended or adjusted under 35 U.S.C. 154(b) by 0 days.

(21) Appl. No.: 17/916,192

(22) PCT Filed: Mar. 1, 2021

(86) PCT No.: PCT/EP2021/054963
§ 371 (c)(1),
(2) Date: Sep. 30, 2022

(87) PCT Pub. No.: WO2021/197724
PCT Pub. Date: Oct. 7, 2021

(65) Prior Publication Data

US 2023/0127674 A1 Apr. 27, 2023

(30) Foreign Application Priority Data

Mar. 31, 2020 (DE) ..... 10 2020 204 195.4

(51) Int. Cl.

| | |
|---|---|
| ***B61L 25/02*** | (2006.01) |
| ***B61L 27/70*** | (2022.01) |
| ***B61L 27/04*** | (2006.01) |

(52) U.S. Cl.
CPC ..... *B61L 25/025* (2013.01); *B61L 27/04* (2013.01); *B61L 27/70* (2022.01); *B61L 2201/00* (2013.01)

(58) Field of Classification Search
CPC ..... B61L 25/025; B61L 27/04; B61L 27/70; B61L 2201/00; B61L 25/021; B61L 2205/04; B60L 2200/26; B60L 15/40
See application file for complete search history.

(56) References Cited

U.S. PATENT DOCUMENTS

| | | | |
|---|---|---|---|
| 10,137,913 | B2 | 11/2018 | Giebel-Roder |
| 10,293,841 | B2 | 5/2019 | Hammerl et al. |

(Continued)

FOREIGN PATENT DOCUMENTS

| | | | |
|---|---|---|---|
| CN | 102085874 | A | 6/2011 |
| CN | 102858615 | A | 1/2013 |

(Continued)

OTHER PUBLICATIONS

Chen Gaofei: "The Control Unit of Trackside ATP from Metro Signal Control System Made by Siemens", Modern Urban Transit Apr. 2012 pp. 14-17—English abstract on p. 17.

*Primary Examiner* — Zachary L Kuhfuss
(74) *Attorney, Agent, or Firm* — Laurence A. Greenberg; Werner H. Stemer; Ralph E. Locher

(57) ABSTRACT

The position of a rail vehicle that is parked on a track is monitored in a cold movement detection. A vehicle-side device of an automatic train safety system is deactivated when the vehicle is parked. Prior to the deactivation, a first positional value is determined by the automatic train safety system, and independently, a second positional value is determined by another localization system. With the vehicle-side device deactivated, the actual position of the vehicle is monitored by the other localization system. The additional positional values and/or a deviation of the actual position (Continued)

from a target position is transmitted to a track-side device of the train safety system. When the vehicle-side device is activated, the track-side device transmits the actual position of the vehicle to the vehicle-side device. If the vehicle has not moved, the automatic train guidance system can immediately assume the monitoring process starting from the first position.

17 Claims, 2 Drawing Sheets

(56) References Cited

U.S. PATENT DOCUMENTS

| | | | | |
|---|---|---|---|---|
| 2009/0187294 | A1* | 7/2009 | James | B61L 25/025 701/19 |
| 2010/0312461 | A1 | 12/2010 | Haynie et al. | |
| 2013/0046421 | A1* | 2/2013 | El Fassi | B61L 27/04 701/2 |
| 2016/0214631 | A1* | 7/2016 | Hammerl | B61L 25/021 |
| 2016/0236697 | A1* | 8/2016 | Giebel-Roder | B61L 15/0063 |
| 2016/0257309 | A1* | 9/2016 | Kumar | B60W 50/0097 |
| 2017/0066458 | A1 | 3/2017 | Huchrowski | |
| 2018/0312182 | A1 | 11/2018 | Prestail et al. | |

FOREIGN PATENT DOCUMENTS

| | | | |
|---|---|---|---|
| CN | 110015322 | A | 7/2019 |
| DE | 102010061878 | A1 | 5/2012 |
| DE | 102011077760 | A1 | 12/2012 |
| DE | 102013219721 | A1 | 4/2015 |
| DE | 102013219812 | A1 | 4/2015 |
| DE | 102014226045 | A1 | 6/2016 |
| EP | 2548784 | A2 | 1/2013 |
| EP | 3240718 | B1 | 6/2019 |
| WO | 2014191141 | A2 | 12/2014 |
| WO | 2015036254 | A1 | 3/2015 |

* cited by examiner

METHOD FOR MONITORING THE POSITION OF A PARKED RAIL VEHICLE, AND COMPUTER PROGRAM, IN PARTICULAR FOR A TRAIN SAFETY SYSTEM

FIELD AND BACKGROUND OF THE INVENTION

The invention relates to a method for monitoring the position of a vehicle parked on a track, wherein

- the vehicle is equipped with a vehicle-side device of an automatic train safety system,
- the vehicle-side device is deactivated when the vehicle is parked.

The invention further relates to a computer program product and to a provisioning device for said computer program product, wherein the computer program product is equipped with program commands for performing said method. The invention also relates to an automatic train control system having an installed computer program.

Automatic train safety systems (=train protection systems) support partially or fully automated operation of rail vehicles. In order to enable this, the train safety systems are equipped in such a way that it is possible to locate the position of the vehicles with a required accuracy at all times. The vehicle-side infrastructure necessary for the tracking requires energy and consequently cannot be used when a rail vehicle is in the power-off state, for example in a parking position in the depot.

In rail-bound local transport, for example, the vehicles are maintained and stabled in depots. To ensure safe operation, the vehicles are equipped with a vehicle-side train safety device (also known as onboard ATP=Automatic Train Protection) which protects the vehicles during routine operation and is able to initiate a braking action if safety frameworks are exceeded. Modern radio-based systems also include a trackside device of the train safety system which reliably tracks the train movements by way of position reports received from the vehicles. CBTC (Communications-Based Train Control) is one example.

During out-of-service periods, the vehicles (trains) and the train safety device should on the one hand be deactivated in order to save energy. On the other hand it is important that the vehicles can be returned to service as quickly as possible in the most convenient operating mode (for example CTC (Continuous Train Control) without a fixed speed restriction to 25 km/h). However, if the vehicle-side train safety device is switched off, the reliably measured and stored vehicle position is lost. This reliable position tracking must be established by means of a time-consuming, driver-controlled low-speed movement over locator beacons (balises) and running in the mode without fixed speed restriction is possible again only after an interval, typically after 250 m or 1 to 2 minutes.

By "cold movement detection" (abbreviated to CMD in the following) is understood the detection of the movement of the vehicle while the vehicle is in the power-off state. This type of monitoring can be used to return the train to service more quickly. In the event that the train has not moved, the train position that the vehicle actually occupied when parked can be assumed as its current position. The vehicle position needs to be corrected in an appropriate manner only if a movement of the vehicle has been detected. There are various technical approaches for a CMD.

The method proposed according to DE 102011 077 760 DE for the safety-related detection of a change in position of a powered-down rail vehicle, in particular a traction unit, is used in the case of rail vehicles which have at least one axle encoder for generating an electrical signal as a function of the angular position of a wheel axle of the rail vehicle and which are equipped with a system for determining the absolute position, i.e. for locating the rail vehicle, the inadequate accuracy of which is made risk-free by means of the proposed method. This can be in particular a satellite navigation system. A CMD is realized in that the axle encoder cooperatively interacts with a state memory which stores movements of the axle up to the time the train is powered up.

EP 3240718 B1 relates to a device for detecting a cold movement of a rail vehicle having a display device and having an actuation device for activating the display device. In this case any movement of the vehicle is determined mechanically, so the vehicle gets by without a power supply while in the power-off state.

However, the described methods for a CMD result in an additional requirement for components in the vehicle. These produce an additional overhead that is incurred in each vehicle both in its original equipment configuration and during operation.

A different approach is taken according to DE 102013 219 812 A1. Here, a detector device in the form of a radar is installed trackside, enabling a vehicle located within the effective range of the radar to be monitored for movement.

The vehicle can additionally be fitted with a suitable reflection apparatus for radar tracking. However, the vehicle must then be parked within the effective range of the detector device. Furthermore, this also results in an additional outlay for components that must be provided for each trackside parking position for vehicles.

SUMMARY OF THE INVENTION

The object of the invention is therefore to disclose a method for monitoring a vehicle parked on a track which, with a minimum possible expenditure on additional components, enables sufficiently reliable monitoring even when a vehicle is in the power-off state. A further object of the invention is to disclose a computer program product as well as a provisioning device for such a computer program product, by means of which the method can be performed. Finally, it is an object of the invention to disclose an automatic train control system by means of which the aforementioned method can be performed.

This object is achieved according to the invention by means of the subject matter of the claim cited in the introduction (method) in that

- prior to the deactivation of the vehicle-side device, a first positional value is determined from the position of the vehicle by the automatic train safety system and, independently thereof, a second positional value is determined by means of a further localization system,
- the second positional value is assigned to the vehicle,
- in the deactivated state of the vehicle-side device, the actual position of the vehicle is monitored by the further localization system by determining further positional values, the second positional value being used as the target position of the vehicle,
- the further positional values and/or a deviation of the actual position from the target position are transmitted to the trackside device of the train safety system, following an activation of the vehicle-side device, the trackside device transmits a positional value representing the actual position of the vehicle to the vehicle-side device.

The first positional value is thus generated by the automatic train safety system while the vehicle is still in operation. This positional value is advantageously a value having an accuracy which can be determined for example as the vehicle passes over a balise. For the second positional value, a further localization system is used which can be for example a depot management system of the depot and which is installed anyway in a train system to ensure the reliable operation of the latter. Advantageously, therefore, no outlay for the installation of a localization system is incurred for determining the second positional value. That said, however, the second positional value is usually less accurate in terms of the reliability of the localization of the vehicle. In no case does the second positional value satisfy the requirements applicable to the automatic protection system. As the first positional value and the second positional value can deviate from one another due to the measurement inaccuracies of both positional values, the second positional value must first be assigned to the vehicle. The first positional value, which was determined by the automatic train safety system, already has an assignment to the vehicle in question. The second positional value can be assigned for example by means of a validity check. Irrespective of a possible deviation of the two positional values from one another, an assignment of the second positional value is possible for example if no other vehicles that come into consideration for an assignment are located in the vicinity of the vehicle in question. Alternatively or in addition, a confidence interval for the deviations of the second positional value from the first positional value can be defined for the assignment.

In the power-off state, the position of the vehicle is now monitored by the further localization system. This entails making use of the second positional value assigned to the vehicle, which is specified as the actual position irrespective of any deviation from the first (and more accurate) positional value during the CMD. The accuracy of the determination of further positional values is sufficient for the CMD, a sufficiently large deviation from the actual position being interpreted as signifying that the vehicle has moved. As a result of the transmission of the further positional values or the deviations of the respective positional values from the second positional value determined by the further localization system to the trackside device of the train safety system, the vehicle remains visible, as it were, to the automatic train safety system even in the fully deactivated state.

This is the reason why, after the vehicle has been powered up, the trackside device of the train safety system can immediately transmit a positional value representing the actual position of the vehicle to the vehicle. This is realized according to the standard applicable to the train safety system such that all the required releases necessary for operation of the vehicle can advantageously be associated with the said positional value.

Which positional value is used to represent the actual position is dependent on the course of the monitoring of the parking position by the further localization system.

If the result of the monitoring of the parking position is that the vehicle has not moved (i.e. that the deviations of the further positional values from the second positional value were minor), the train safety system uses the first positional value since this possesses a higher accuracy.

If, however, the result of the monitoring of the parking position is that the vehicle has moved (i.e. that the deviations of the further positional values from the second positional value were so significant that a relative movement of the vehicle must be assumed), the first positional value is unusable. The most recent of the further positional values is transmitted instead. If the train safety system has received no positional values transmitted by the further localization system but instead receives the deviations of the further positional values from the second positional value, a positional value is determined taking into account the first positional value and the transmitted deviations and is passed on as the positional value representing the position. Only in these cases is a subsequent supervision run necessary in order once again to determine a more accurate positional value required for the operation of the train safety system.

The advantage of the invention lies in the making use of normally external location information for the train safety system, which information is unused because it is unreliable. With the present invention, the vehicle can therefore be fully powered down (no energy consumption in the parking position) and, after being powered up again, is instantly available once more to the train safety system with accurate location information (the first positional value), as a result of which a resumption of service is normally possible without a prior manual locating run. A locating run is therefore necessary only when a movement of the vehicle has been detected by monitoring of the second positional value (comparison with the further positional values).

The method according to the invention can be performed by means of a depot management system in a depot for vehicles as follows, for example. The tracking server of the depot management system, i.e. the local localization system, (e.g. Simatic RTLS) determines the current parking position of every vehicle (in this example, without loss of generality, every train) in the depot at regular intervals by way of installed reference points (anchor points), radio and triangulation methods through determination of further positional values. According to the invention, said parking position of each train is made available to the trackside device of the train safety system. Before being deactivated, it synchronizes the measured second positional value with the train position tracked by the automatic train safety system, the first positional value (in the CBTC system, Trainguard MT with the OPR onboard position reports of the trains) in order to rule out systematic errors.

According to the invention, after the train is powered down, the trackside device of the train safety system continually monitors the position received from the further localization system. The position determined by the further localization system is in this case repeatedly determined afresh at fixed intervals by means of radio and triangulation methods and in said fixed intervals is also communicated to the trackside device of the train safety system. A volume of data consisting of location information is therefore available in the trackside device of the train safety system. A relative movement of the train can be determined from said volume of data, a measurement error resulting from a deviation of the second positional value from the first positional value already having been neutralized by the synchronization of said two positional values. According to the invention, after being reactivated, the trackside device of the train safety system can report its position to the train.

Unless indicated otherwise in the following description, the terms "create", "calculate", "compute", "detect", "generate", "configure", "modify" and the like preferably refer to actions and/or processes and/or processing steps which modify and/or generate data and/or convert the data into other data. In this case the data is present in particular as physical variables, for example as electrical impulses or else as measured values. The necessary instructions/program commands are combined in the form of software in a computer program. Furthermore, the terms "receive", "transmit", "read in", "read out", "transfer" and the like refer to the cooperative interaction between individual hardware components and/or software components via interfaces. The interfaces can be realized in hardware, for example hard-wired or as a radio circuit, and/or in software, for example as an interaction between individual program modules or program sections of one or more computer programs.

By "computer-aided" or "computer-implemented" may be understood in the context of the invention for example an implementation of the method in which a computer or a plurality of computers performs or perform at least one method step of the method. The term "computer" is to be construed broadly as covering all electronic devices having data processing characteristics. Computers can therefore include for example personal computers, servers, handheld computer systems, Pocket PC devices, mobile radio devices and other communication devices which process data in a computer-aided manner, processors and other electronic devices for data processing, which preferably can also be combined to form a network. By "memory unit" or "storage unit" may be understood in the context of the invention for example a computer-readable memory in the form of a random access memory (RAM) or a data storage device (hard disk drive or data medium).

By a "processor" may be understood in the context of the invention for example a machine, for example a sensor for generating measured values or an electronic circuit. A processor may be in particular a central processing unit (CPU), a microprocessor or a microcontroller, for example an application-specific integrated circuit or a digital signal processor, possibly in combination with a memory unit for storing program commands, etc. A processor may also be for example an IC (integrated circuit), in particular an FPGA (field programmable gate array) or an ASIC (application-specific integrated circuit), or a DSP (digital signal processor). By a processor may also be understood for example a virtualized processor or a Soft CPU. It may also be a programmable processor that is equipped with a configuration for performing a computer-aided method.

According to an embodiment of the invention it is provided that a tolerance range is specified for the deviation of the actual position from the target position, the train safety system ruling out a movement of the vehicle as evaluation result while the actual position lies within the tolerance range.

Specifying a tolerance range in order to decide whether the vehicle has moved is advantageously a particularly simple means of enabling the actual position of the vehicle to be monitored. Alternatively, there are also other possibilities. For example, the evolution of the further positional values can be followed in order to determine whether an ongoing movement of the vehicle can be detected. This can be assumed if a drift of the further positional values is observed. By this means it can be ruled out for example that individual measured values, referred to as outliers, which suggest a movement of the vehicle lead to the conclusion that a measurement run must be performed after the vehicle enters into service even though this would not be at all necessary.

According to an embodiment of the invention it is provided that the target position is a parking position for the vehicle.

This type of monitoring is particularly advantageous when vehicles are stabled in a depot over a relatively long period of time. The depot provides different parking positions for the vehicles, to which the vehicles can be moved so that they can be taken out of service (powered down) there. As regards the parking positions, it is particularly advantageous that a tolerance is specified for the further positional values to the effect that vehicles which are parked one behind the other on a track cannot collide. For this purpose a safety clearance must be observed, the tolerance range being required to be smaller than said safety clearance. Preferably, the tolerance range can be chosen as less than 50%, more preferably less than 30% and even more preferably less than 25% of the safety clearance between parking positions of adjacent vehicles.

According to an embodiment of the invention it is provided that the tolerance range allows a deviation from the target position of less than 100 cm, preferably less than 50 cm and most preferably less than 20 cm.

Given such a specification of the tolerance range, it is taken into consideration that this must be sufficiently precise so that the vehicle can be returned to service taking into account the first positional value. If this is the case, the confidence interval within which the vehicle could have moved must not be set overgenerously since the automatic train safety system does not recognize a position deviation associated with a movement within the tolerance range. It should be noted that the first positional value is corrected by the automatic train safety system as soon as the latter determines a more recent positional value, upon passing over a balise for example.

According to an embodiment of the invention it is provided that the train safety system refuses control for the departure of the vehicle if the result of a comparison of the actual position with the target position reveals that the vehicle has moved during the deactivated state of the vehicle-side device.

The refusal of control for the departure of the vehicle advantageously represents an improvement in safety. By this measure it is ensured that the vehicle is not inadvertently started by means of the train safety system even though it has left its target position while in the power-off state. The train safety system cannot be reactivated until a supervision run has been completed, the supervision run serving to determine the position of the vehicle in a reliable manner.

According to an embodiment of the invention it is provided that the train safety system releases a manual supervision run, the train safety system taking over control of the vehicle as soon as a localization has been completed by the train safety system.

A manual supervision run is carried out by trained operating personnel. The supervision run serves to provide a reliable determination of the vehicle's position. During this process, the operating personnel can make use of certain position markers or be supported by technical facilities of the train safety system. In any event it is possible for the operating personnel to check the validity of a position determination before releasing the handover of the vehicle to the train safety system. It is also possible for the operating personnel to establish the reason why a vehicle has moved from its parking position while in the power-off state.

According to an embodiment of the invention it is therefore provided that the train safety system is able to take over control only when a manual release has been completed first, the train safety system waiting for a release signal to this effect. A switch known as an ATO start button can be provided for this purpose, for example.

According to an embodiment of the invention it is provided that the train safety system takes over control for the departure of the vehicle in a secure mode when a comparison of the actual position with the target position returns the result that the vehicle has moved during the deactivated state of the vehicle-side device, the control being based on the actual position as the positional value.

The secure mode includes safety measures which are intended to prevent an accident, for example a low maximum permitted speed of e.g. 25 km/h. Automatic operation in a secure mode (without manual supervision run) can advantageously be chosen when the risk of an accident is very low in this situation. This is the case for example if the vehicle was parked in a depot and, upon exiting the depot, after covering a comparatively short distance (for example less than 100 m, preferably less than 50 m, even more preferably less than 25 m), a trackside locating device such as a balise, for example, is able to deliver a reliable positional value for the automatic train safety system.

According to an embodiment of the invention it is therefore provided that the train safety system accepts a current positional value as soon as the latter has been determined by the passing of a trackside locating device of the train safety system, and the train safety system subsequently terminates the secure mode. The automatic train safety system can then take over full control once more.

According to an embodiment of the invention it is provided that following an activation of the vehicle-side device, the actual position of the vehicle or a deviation of the actual position from the target position of the vehicle is displayed in a display device in the vehicle.

The display in the vehicle advantageously simplifies in particular a manual supervision run. The level of the deviation can be rated as a measure for the hazard potential.

According to an embodiment of the invention it is provided that following an activation of the vehicle-side device, the actual position of the vehicle or a proposal for a calculated position of the vehicle is displayed, in which case an input device may be used to enter a confirmation that verifies that the actual position or the proposal of the calculated position coincides with the true position of the vehicle.

The output of the actual position in the vehicle enables qualified train personnel to match the displayed location with reality during a manual supervision run. If the train personnel are able to confirm a reliable localization of the vehicle (for example by way of the already mentioned ATO start button), the automatic train safety system can once again take over control.

According to an embodiment of the invention it is provided that the further localization system can be formed by a satellite-based navigation system and/or a local tracking system installed at the location where the vehicle is powered down.

The local tracking system installed at the location where the vehicle is powered down consists of the facilities and equipment already provided for example in a vehicle depot as tracking infrastructure (already mentioned above). Advantageously, there is therefore no additional outlay for components in order to realize the method according to the invention.

Alternatively hereto, however, it is also possible to make use of a satellite-based navigation system such as GPS, for example. In this case it is necessary for the vehicle to have a GPS receiver. Compared to the other functional components of the vehicle, this requires significantly less energy, so a saving in terms of energy consumption is achieved even if a GPS receiver remains in operation in the vehicle while the latter is in the power-off state. Moreover, a GPS receiver can be purchased at an affordable price and is easy to install, so the additional expense resulting due to GPS localization remains within narrow limits.

Furthermore, a computer program product comprising program commands for performing the cited method according to the invention and/or its exemplary embodiments is claimed, the method according to the invention and/or its exemplary embodiments being able to be performed in each case by means of the computer program product.

Also claimed is a provisioning device for storing and/or providing the computer program product. The provisioning device is for example a data medium which stores and/or provides the computer program product. Alternatively and/or in addition, the provisioning device is for example a network service, a computer system, a server system, in particular a distributed computer system, a cloud-based computer system and/or a virtual computer system which stores and/or provides the computer program product preferably in the form of a data stream.

The computer program product is provided for example as a download in the form of a program data block and/or command data block, preferably as a file, in particular as a download file, or as a data stream, in particular as a download data stream, of the full computer program product.

Alternatively, however, said product can be provided for example as a partial download consisting of a plurality of parts and in particular is downloaded via a peer-to-peer network or provided as a data stream. Such a computer program product is read into a system for example using the provisioning device in the form of the data medium and executes the program commands such that the method according to the invention is performed on a computer.

Alternatively, the cited object is also achieved according to the invention by means of the subject matter of the claim cited in the introduction (automatic train control system) in that a computer program product of the above-described type is stored in the trackside device or both in the trackside device and in the vehicle-side device.

As a result, the automatic train control system is advantageously able to perform the described method automatically or at least in a partially automated manner. The above-described advantages are achieved in the process.

At least the trackside device is equipped with the computer program. This variant has the advantage that not all vehicles need to be retrofitted with the program if these are already in service. In the case of new vehicles, the vehicles can also be equipped with the computer program in addition. This has the advantage that the method can be executed in its full scope in an automated manner and at the same time is also supported by the vehicle itself.

Further details of the invention are described below with reference to the drawing. Like or corresponding elements in the drawing are labeled with the same reference signs in each case and are explained more than once only insofar as there are differences between the individual figures.

The exemplary embodiments explained hereinbelow are preferred embodiment variants of the invention. In the exemplary embodiments, the described components of the embodiment variants in each case represent individual features of the invention which are to be considered independently of one another and which in each case also develop the invention independently of one another and therefore are also to be regarded individually or in a different combination than that shown as part of the invention. Furthermore, the described embodiment variants can also be supplemented by further of the already described features of the invention.

DETAILED DESCRIPTION OF THE INVENTION

Figure 1:
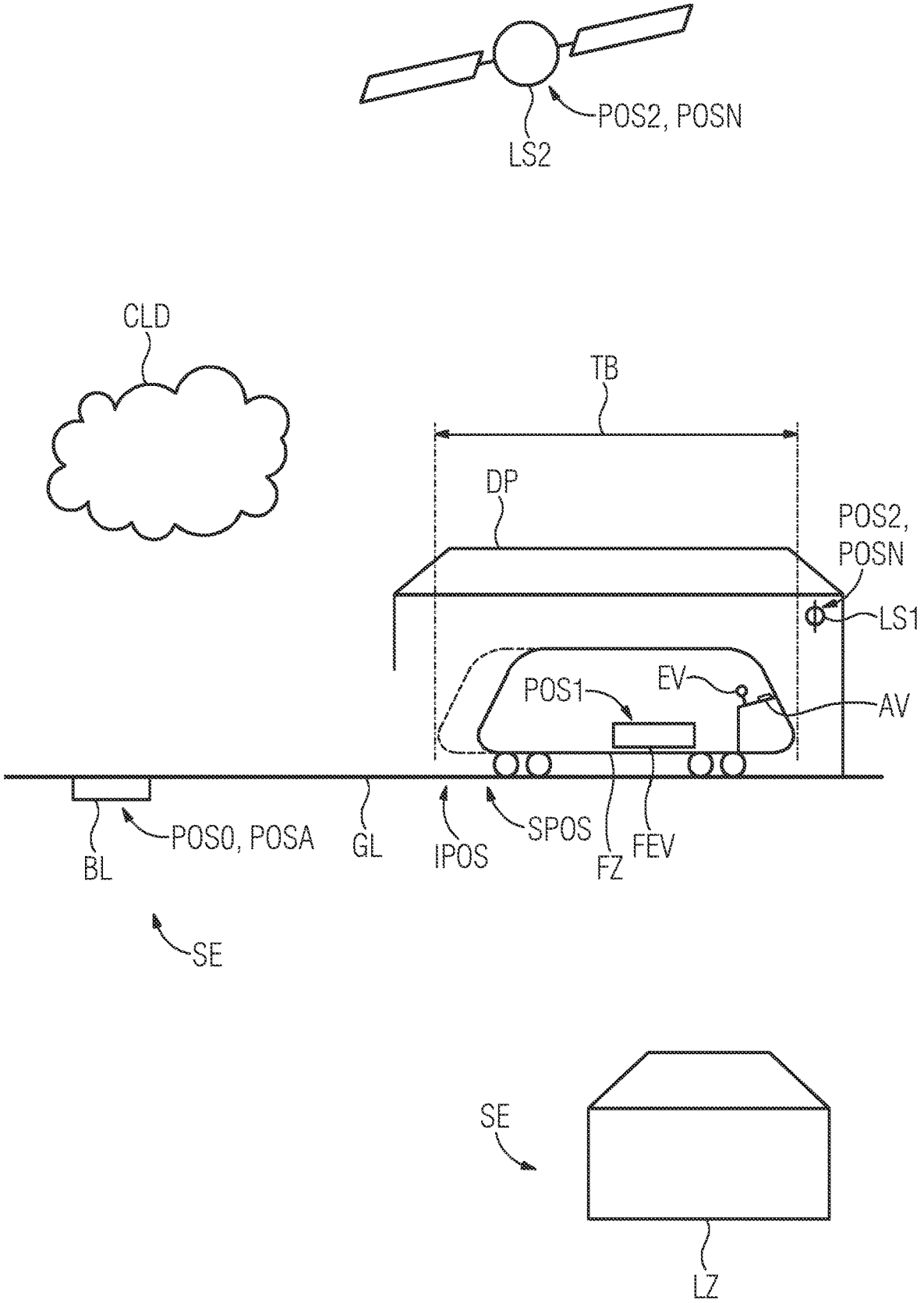
FIG. 1 shows in the form of a schematic drawing an exemplary embodiment of the automatic train safety system (trackside device) according to the invention at the time an exemplary embodiment of the method according to the invention is performed.

FIG. 1 shows a track GL on which there stands a vehicle FZ. This is parked in a target position SPOS in a depot DP. The vehicle also comprises a vehicle-side device FE of an automatic train safety system (for example CBTC). This is able to communicate with a trackside device SE of the automatic train safety system when the vehicle FZ is in operation. The trackside device SE of the automatic train safety system is represented by a control center LZ and a trackside locating device in the form of a balise BL.

In the position shown, a parking position, the vehicle FZ is monitored by a further localization system LS1, which is housed locally in the depot DP, and/or by a further localization system LS2, which is formed by a satellite representing a satellite-based navigation system.

All the cited functional units according to FIG. 1 communicate with a cloud CLD (an exception is the further localization system LS2 in the form of a satellite, which is used solely for the satellite-based localization of the vehicle FZ). Thus, the inventive method according to FIG. 1 is supported by a cloud computing system. However, this is only one possible variant. The functional units can equally communicate with one another directly in a manner not shown by means of wired interfaces or radio interfaces.

A "cloud" (computer cloud or data cloud) is to be understood as a "cloud computing" environment. What is meant is an IT infrastructure which is made available via a network such as the internet. It usually includes storage space, computing power or application software as a service, without this having to be installed on the local computer using the cloud. These services are provided and used in this case exclusively by means of technical interfaces and protocols, for instance by means of a web browser. The range of services offered within the scope of cloud computing covers the entire spectrum of information technology and includes among other things infrastructure, platforms and software.

According to FIG. 1, the inventive method can be performed in the following sequence. When the vehicle FZ enters via the track GL, it passes over the trackside locating device BL, as a result of which a positional value POS0 is determined as a reference. The vehicle FZ then heads to its target position SPOS in the depot DP. Based on the positional value POS0, the automatic train safety system is able to determine the first positional value POS1. This is calculated with a precision that is dictated by the technical requirements of the automatic train safety system.

At the same time, at least one of the further localization systems LS1, LS2 can determine a second positional value POS2, where both the first positional value POS1 and the second positional value POS2 represent the target position SPOS of the vehicle FZ but may diverge from one another due to potential measurement errors. Regardless of deviations, the second positional value POS2 is assigned to the vehicle FZ.

The vehicle FZ is then powered down, with the result that the vehicle-side device FE can no longer be used and so a localization by the trackside device SE of the automatic train safety system is no longer possible. Instead, the further localization system LS1, LS2 takes over the tracking of the vehicle FZ. The monitoring serves to detect whether said vehicle FZ leaves the designated target position SPOS and consequently is in reality located at an actual position IPOS.

As long as the determined actual position IPOS lies within a tolerance range TB, it is assumed that the vehicle FZ has not moved (deviations of the further positional values POSN are then based on measurement inaccuracies) or that the vehicle has moved so little that this poses no risk for a startup by means of the automatic train safety system. However, if the measured actual position IPOS lies outside the tolerance range TB, it is assumed that the vehicle FZ has moved. The measured positions POS1, POS2, POSN or their deviations from the second position POS2 are also transmitted to the control center LZ by the further localization system LS1, LS2, with the result that the automatic train safety system can register a leaving of the target position SPOS at least on the track side.

If the vehicle FZ is powered up again, the actuation of the vehicle FZ by the trackside device SE of the automatic train safety system is dependent on the result of the monitoring by the further localization system LS1, LS2. If no movement of the vehicle FZ could be detected, automatic control by means of the automatic train safety system can begin immediately starting from the first position POS1. If, on the other hand, a movement of the vehicle FZ was detected, a further positional value POSN representing the actual position IPOS is taken as a basis in order to move the vehicle FZ either in a secure mode by means of the train safety system or manually by the train personnel.

As soon as the vehicle FZ passes over the trackside locating device BL, an accurate current positional value POSA is generated in any case as a reference, with which the automatic train safety system will work henceforth. Normal service can be resumed as a result.

Figure 2:
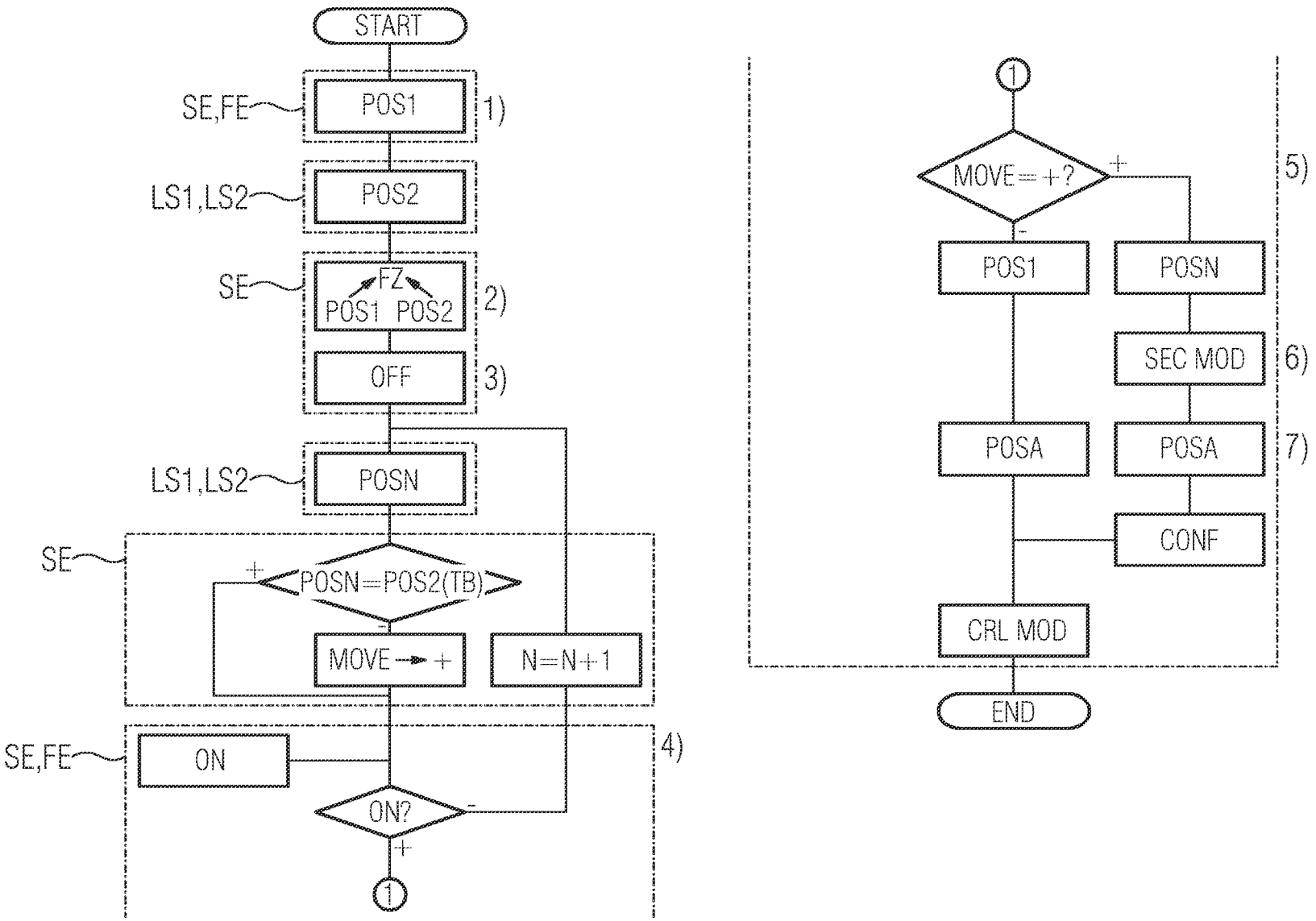
FIG. 2 shows an exemplary embodiment of the method according to the invention as a flowchart.

FIG. 2 reveals the following method steps for the processing sequence of the method. Dash-dotted lines serve to indicate in which functional units according to FIG. 1 the different method steps can preferably be executed. The numbering of the following steps is also illustrated in FIG. 2.

1) Entry into the depot DP. The trackside device SE of the train safety system determines the first position POS1 and the local localization system LS1, LS2 starts the tracking process by determining the second positional value POS2.

2) Train comes to a stop: Mapping of the two known positional values POS1, POS2 by means of the trackside device SE of the train safety system. In other words, the second positional value POS2 is assigned to the first positional value POS1 and thereby to the vehicle FZ.

3) Vehicle is powered down (OFF in FIG. 2). The train safety system no longer receives its own onboard position reports, but instead constantly checks the further positional values POSN received from the further localization system LS1, LS2. The further positional values POSN are thereupon checked to confirm whether they lie within the tolerance range POS2(TB) predefined by means of the second positional value. If yes, an output value MOVE of the vehicle FZ indicating a movement is set to positive.

4) The vehicle FZ is powered up once more and the vehicle-side device FE of the train safety system registers with the trackside device SE. A query whether the vehicle FZ has been powered up thus no longer leads (as previously) to a repetition of the determining of further positional values POSN (N=N+1 in FIG. 2), but instead the method is continued.

5) If the output value MOVE is negative, the trackside device SE transmits the first positional value POS1 as the original vehicle position to the vehicle-side device of the train safety system. If the output value MOVE is positive, the current position POSN is transmitted.

If desired or necessary for safety experts, the driver, if present, could confirm a proposed location presented in the driver display by means of an acknowledgement pushbutton (not shown).

6) The vehicle-side device FE puts the vehicle FZ into the most convenient operating mode. This is automatic mode CRL MOD of the train control system if the output value MOVE is negative, and a secure mode SEC MOD is set only if the output value MOVE is positive.

7) If desired or necessary for safety experts, the vehicle, upon passing the first regular balise (trackside locating device), will synchronize the tracking information, i.e. the current positional value POSA, from the balise with the previously received and further-computed position. By pressing (optional) the ATO start button (manual confirmation step CONF) or by means of a command from the control center LZ, the vehicle FZ is thereupon set in motion and can then be operated in the automatic mode CRL MOD.

LIST OF REFERENCE SIGNS

GL Track
BL Trackside locating device (balise)
DP Depot
LZ Control center
FZ Vehicle
FE Vehicle-side device of the automatic train safety system
AV Display device
EV Input device
SE Trackside device of the automatic train safety system
LS1 Further localization system (local)
LS2 Further localization system (satellite-based)
TB Tolerance range
SPOS Target position
IPOS Actual position
POS1 First positional value
POS2 Second positional value
POSN Further positional value
POSA Current positional value
OFF Power-down step
ON Power-up step
SEC MOD Secure mode of the train safety system
CRL MOD Automatic mode of the train safety system
CONF Manual confirmation step (optional)

The invention claimed is:

1. A method for monitoring a position of a vehicle parked on a track, the method which comprises:

providing the vehicle with a vehicle-side device of an automatic train safety system, and fully powering down the vehicle including deactivating the vehicle-side device when the vehicle is parked;

prior to deactivating the vehicle-side device, determining a first positional value from the position of the vehicle by the automatic train safety system and, independently thereof, externally determining a second positional value by a further localization system;

assigning the second positional value to the vehicle;

in a deactivated state of the vehicle-side device, monitoring an actual position of the vehicle by the further localization system and externally determining further positional values, thereby using the second positional value as a target position of the vehicle;

transmitting at least one of the further positional values or a deviation of the actual position from the target position to a trackside device of the train safety system; and following an activation of the vehicle-side device, transmitting a positional value representing the actual position of the vehicle from the trackside device to the vehicle-side device;

wherein if a result of the monitoring of the actual position is that the vehicle has not moved, the first positional value is transmitted as the positional value; and wherein if the result of the monitoring of the actual position is that the vehicle has moved, a most recent one of the at least one of the further positional values is transmitted as the positional value.

2. The method according to claim 1, which comprises specifying a tolerance range for the deviation of the actual position from the target position, and ruling out a movement of the vehicle by the train safety system as an evaluation result while the actual position lies within the tolerance range.

3. The method according to claim 2, wherein the tolerance range allows a deviation from the target position by less than 100 cm.

4. The method according to claim 3, wherein the tolerance range allows a deviation from the target position by less than 50 cm.

5. The method according to claim 2, wherein the tolerance range allows a deviation from the target position by less than 20 cm.

6. The method according to claim 1, wherein the target position is a parking position for the vehicle.

7. The method according to claim 1, wherein the train safety system refuses control for a departure of the vehicle when a comparison of the actual position with the target position reveals that the vehicle has moved during the deactivated state of the vehicle-side device.

8. The method according to claim 7, which comprises releasing the vehicle by the train safety system for a manual supervision run, and taking over a control of the vehicle as soon as a localization has been completed by the train safety system.

9. The method according to claim 8, wherein the train safety system is configured to take over control only when a manual release has been completed first, wherein the train safety system waits for a release signal signifying the manual release.

10. The method according to claim 1, which comprises taking over control for a departure of the vehicle by the train safety system in a secure mode when a result of a comparison of the actual position with the target position reveals that the vehicle has moved during the deactivated state of the vehicle-side device, wherein the control is based on the actual position being the positional value.

11. The method according to claim 10, which comprises accepting a current positional value by the train safety system as soon as the current positional value has been determined by a passing of a trackside locating device of the train safety system, and subsequently terminating the secure mode by the train safety system.

12. The method according to claim 1, which comprises, following an activation of the vehicle-side device, displaying the actual position of the vehicle or the deviation of the actual position from the target position of the vehicle on a display device in the vehicle.

13. The method according to claim 1, which comprises, following an activation of the vehicle-side device, displaying the actual position of the vehicle or a proposal for a calculated position of the vehicle, and providing an input device to enable entering a confirmation verifying that the actual position or the proposal of the calculated position coincides with a true position of the vehicle.

14. The method according to claim 1, wherein the further localization system is a system selected from the group consisting of a satellite-based navigation system and a local tracking system installed at the location where the vehicle is powered down.

15. A computer program product, comprising program commands in non-transitory form for performing the method according to claim 1.

16. A non-transitory computer program carrier containing a computer program with computer code for performing the method according to claim 1.

17. An automatic train control system, comprising:

a computer program product with computer code for performing the method according to claim 1;

said computer code being stored in a trackside device of the automatic train control system; or both in the trackside device of the automatic train control system and in a vehicle-side device mounted in a train vehicle.

* * * * *